US007949142B2

(12) United States Patent
Song

(10) Patent No.: US 7,949,142 B2
(45) **Date of Patent: *May 24, 2011**

(54) SILICON CONDENSER MICROPHONE HAVING ADDITIONAL BACK CHAMBER AND SOUND HOLE IN PCB

(75) Inventor: Chung Dam Song, Seoul (KR)

(73) Assignee: BSE Co., Ltd., Incheon (KR)

( * ) Notice: Subject to any disclaimer, the term of this patent is extended or adjusted under 35 U.S.C. 154(b) by 119 days.

This patent is subject to a terminal disclaimer.

(21) Appl. No.: 11/919,688

(22) PCT Filed: Aug. 7, 2006

(86) PCT No.: PCT/KR2006/003092

§ 371 (c)(1),
(2), (4) Date: Oct. 31, 2007

(87) PCT Pub. No.: WO2007/129787

PCT Pub. Date: Nov. 15, 2007

(65) Prior Publication Data

US 2009/0092274 A1 Apr. 9, 2009

(30) Foreign Application Priority Data

May 9, 2006 (KR) ..... 10-2006-0041660

(51) Int. Cl.
*H04R 25/00* (2006.01)

(52) U.S. Cl. ..... 381/174; 381/175; 381/189; 381/190; 381/191

(58) Field of Classification Search ..... 381/174
See application file for complete search history.

(56) References Cited

U.S. PATENT DOCUMENTS 6,781,231 B2 8/2004 Minervini
(Continued)

FOREIGN PATENT DOCUMENTS

DE 103 03 263 A1 8/2004
(Continued)

OTHER PUBLICATIONS

J.W. Weigold, et al; "A MEMS Condenser Microphone for Consumer Applications" Micro Electro Mechanical Systems, 2006. MEMS 2006 Istanbul. 19th IEEE International Conference on Istanbul, Turkey Jan. 22-26, 2006, Piscataway, NJ, USA, IEEE Jan. 22, 2006 pp. 86-89, XP010914531 ISBN: 978-0-7803-9475-9 abstract, paragraphs [0001], [0002].

(Continued)

*Primary Examiner* — Curtis Kuntz
*Assistant Examiner* — Matthew Eason
(74) *Attorney, Agent, or Firm* — Ladas & Parry LLP

(57) ABSTRACT

A silicon condenser microphone has an additional back chamber and a sound hole in a PCB. The microphone includes a case for blocking an external sound; a substrate including a chamber case, a MEMS chip having an additional back chamber formed by the chamber case, an ASIC chip for operating the MEMS chip, a conductive pattern for a bonding to the case, and a sound hole for passing the external sound. A fixing means fixes the case to the substrate and an adhesive is applied to an entirety of a bonding surface of the case and the substrate fixed by the fixing means. When the sound hole is formed through the PCB instead of the case, the mounting space for a microphone is reduced. The chamber case forms the additional back chamber under the MEMS chip and is employed to increase back chamber space to improve sensitivity and reduce noise.

7 Claims, 4 Drawing Sheets

U.S. PATENT DOCUMENTS

| | | | | |
|---|---|---|---|---|
| 7,436,054 | B2 * | 10/2008 | Zhe | 257/686 |
| 2003/0021432 | A1 | 1/2003 | Scheeper et al. | |
| 2004/0046245 | A1 | 3/2004 | Minervini | |
| 2004/0202345 | A1 | 10/2004 | Stenberg et al. | |
| 2005/0018864 | A1 * | 1/2005 | Minervini | 381/175 |
| 2005/0025328 | A1 | 2/2005 | Song | |

FOREIGN PATENT DOCUMENTS

| | | | |
|---|---|---|---|
| EP | 0 613 196 | A2 | 8/1994 |
| EP | 1 047 295 | A2 | 10/2000 |
| JP | 2-63590 | U | 5/1990 |
| JP | 2000-048952 | A | 2/2000 |
| JP | 2000-307022 | A | 11/2000 |
| JP | 2001-083004 | A | 3/2001 |
| JP | 2003-508997 | A | 3/2003 |
| JP | 2004-200766 | | 7/2004 |
| JP | 2007-178221 | A | 7/2007 |
| JP | 2008-510427 | T | 4/2008 |
| WO | 01/19133 | A1 | 3/2001 |
| WO | 03/090281 | A2 | 10/2003 |
| WO | WO 2005 086535 | | 9/2005 |
| WO | 2006/023016 | A1 | 3/2006 |

OTHER PUBLICATIONS

Japanese Office Action, Appln. No. 2008-514568, mailed Oct. 5, 2010 with concise statement of relevance for ref. JP2-63590.

European Search Report: EP 06 78 3527.

European Search Report: EP 10 00 0467.

* cited by examiner

SILICON CONDENSER MICROPHONE HAVING ADDITIONAL BACK CHAMBER AND SOUND HOLE IN PCB

TECHNICAL FIELD

The present invention relates to a condenser microphone, and more particularly to a silicon condenser microphone having an additional back chamber and a sound hole in a PCB.

BACKGROUND ART

Generally, a condenser microphone widely used in a mobile communication terminal and an audio system comprises a voltage bias element, a pair of a diaphragm and backplate for constituting a capacitor C varying according to a sound pressure, and a JFET (Junction Field Effect Transistor) for buffering an output signal. The conventional condenser microphone is assembled by sequentially inserting a vibrating plate, a spacer ring, an insulation ring, a backplate and a conductive ring in a case, and finally inserting a PCB and curling an end portion of the case toward the PCB.

Recently, a semiconductor processing technique using micromachining is proposed as a technique for integrating a microscopic device. MEMS (Micro Electro Mechanical System) employs a semiconductor manufacturing process, an integrated circuit technology, in particular, to manufacture a microscopic sensor, an actuator and an electromechanical structure having a size in units of microns. In accordance with a MEMS chip microphone manufactured via the micromachining technology, conventional components of the microphone such as the vibrating plate, the spacer ring, the insulation ring, the backplate and the conductive ring may be miniaturized and integrated, and may have high performance, multi-function, high stability and a high reliability through a high precision microscopic process.

FIG. 1 is a diagram exemplifying a conventional MEMS chip structure used in a silicon condenser microphone. Referring to FIG. 1, a MEMS chip 10 has a structure wherein a backplate 13 is formed on a silicon wafer 14 using MEMS technology, and a vibrating plate 11 is disposed having a spacer 12 therebetween. The backplate 13 includes a sound hole 13*a* formed therein, and the MEMS chip 10 is generally manufactured by micromachining technology and a semiconductor chip manufacturing technology.

FIG. 2 is a lateral cross-sectional view illustrating a conventional silicon condenser microphone employing the MEMS chip. Referring to FIG. 2, a conventional silicon condenser microphone 1 is assembled by mounting the MEMS chip 10 and an ASIC (application specific integrated circuit) chip 20 on a PCB 40 and inserting the same in a case 30 having a sound hole 30*a* formed therein.

However, as shown in FIG. 2, because a back chamber 15 of the conventional silicon condenser microphone 1 is formed by the MEMS chip 10, a space of the back chamber 15 is extremely small due to a size of the MEMS chip 10 which is a semiconductor chip. Therefore, a sound quality of the microphone is degraded.

SUMMARY

It is an object of the present invention to provide a silicon condenser microphone having an additional back chamber and a sound hole in a PCB in order to improve an acoustic characteristic.

In order to achieve the above-described object, there is provided a silicon condenser microphone comprising: a case for blocking an inflow of an external sound; a substrate including a chamber case, a MEMS chip having an additional back chamber formed by the chamber case, an ASIC chip for operating the MEMS chip, a conductive pattern for bonding to the case, and a sound hole for passing the external sound therethrough; a fixing means for fixing the case to the substrate; and an adhesive for a bonding the case and the substrate, wherein the adhesive is applied to an entirety of a bonding surface of the case and the substrate fixed by the fixing means.

As described above, the present invention includes a chamber case for forming an additional back chamber under a MEMS chip in order to increase a back chamber space of the MEMS chip, thereby improving sensitivity and noise problems such as a THD (Total Harmonic Distortion).

In addition, when a sound hole is formed in a substrate instead of a case, the microphone may be mounted on a main PCB via various methods. Therefore, a mounting space may be small. In addition, since the case is fixed to a PCB by a laser welding and bonded by an adhesive, the case is fixed during the bonding to prevent a generation of a defect, and a mechanical firmness is improved due to a high bonding strength. Thereby the silicon condenser microphone in accordance with the present invention is robust to external noise, and reduces a processing cost and the manufacturing cost.

While the present invention has been particularly shown and described with reference to the preferred embodiment thereof, it will be understood by those skilled in the art that various changes in form and details may be effected therein without departing from the spirit and scope of the invention.

DETAILED DESCRIPTION OF PREFERRED EMBODIMENTS

The above-described objects and other objects and characteristics and advantages of the present invention will now be described in detail with reference to the accompanied drawings.

Figure 3:
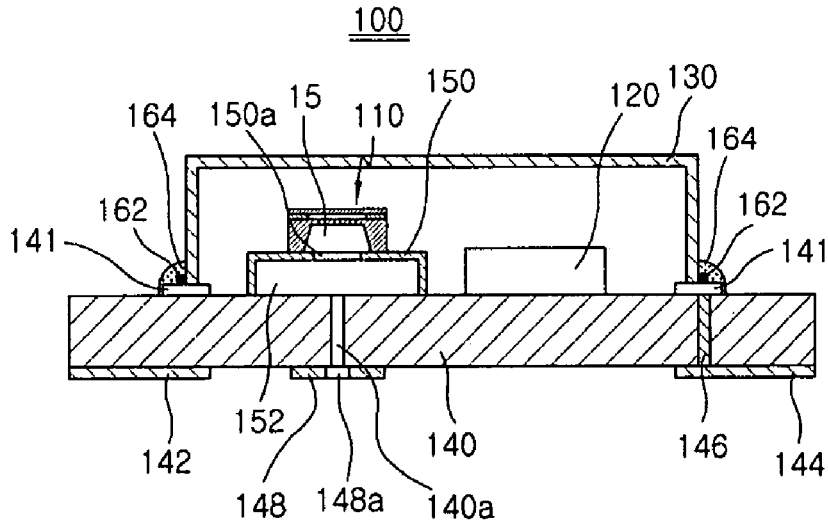
FIG. 3 is a lateral cross-sectional view illustrating a silicon condenser microphone having an additional back chamber and a sound hole in a PCB in accordance with a first embodiment of the present invention.

FIG. 3 is a lateral cross-sectional view illustrating a silicon condenser microphone having an additional back chamber and a sound hole in a PCB in accordance with a first embodiment of the present invention.

As shown in FIG. 3, the silicon condenser microphone 100 having an additional back chamber 152 and a sound hole 140*a* in accordance with the first embodiment has a structure wherein a chamber case 150 for forming the additional back chamber 152 and an ASIC chip 120 for driving an electrical signal of a MEMS chip 110 are disposed on a PCB substrate 140 having a conductive pattern 141 and connection terminals 142 and 144, a MEMS chip 110 is disposed on the chamber case 150, and a case 130 is attached to the PCB substrate 140. The conductive pattern 141 and the ground connection terminal 144 are connected via a through-hole 146.

Figure 1:
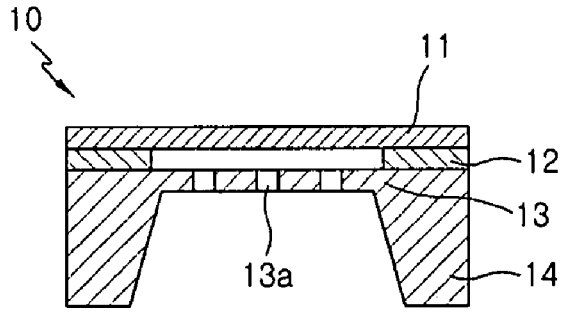
Figure 1 (Prior Art)
FIG. 1 is a diagram exemplifying a conventional MEMS chip structure used in a silicon condenser microphone.
Figure 2:
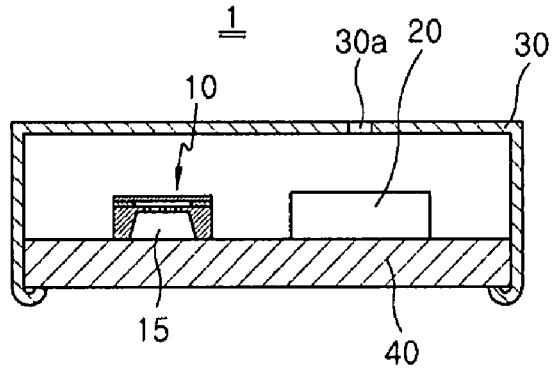
Figure 2 (Prior Art)
FIG. 2 is a lateral cross-sectional view illustrating a conventional silicon condenser microphone employing a MEMS chip.

The chamber case 150 increases a space of the back chamber of the MEMS chip 110 to improve sensitivity and improve noise problems such as THD (Total Harmonic Distortion), wherein a through-hole 150*a* for connecting a back chamber 15 formed by the MEMS chip 110 with the additional back chamber 152 is disposed on an upper surface of the chamber case 150. The MEMS chip 110 has a structure wherein the backplate 13 is formed on the silicon wafer 14 using the MEMS technology and the vibrating plate 11 is formed to have the spacer 12 therebetween as shown in FIG. 1. The chamber case 150 may have a shape of a square pillar or a cylinder, and may be manufactured using a metal or a mold resin. In addition, although not shown, electrical wiring is disposed on the chamber case 150 so as to transmit the electrical signal of the MEMS chip 110 to the ASIC chip 120.

The chamber case 150 having the through-hole 150*a* on an upper surface thereof for forming the additional back chamber, the MEMS chip 110 attached on the through-hole 150*a* of the chamber case 150 to expand the back chamber, and the ASIC chip 120 are disposed on the PCB substrate 140. The conductive pattern 141 is disposed on a portion of the PCB substrate 140 that is in contact with the case 130. The sound hole 140*a* for passing through an external sound is disposed at a position wherein the chamber case 150 is mounted, a sealing pad 148 for carrying out a hole sealing of the sound hole 140*a* by soldering for preventing a distortion of a sound wave in a space between a main PCB (reference numeral 310 in FIG. 7) and the microphone is disposed around the sound hole 140*a* disposed at a lower surface of the PCB substrate 140. A reference numeral 148*a* denotes a sound hole formed by the sealing pad 148.

The case 130 is a metal case having one surface open wherein the case 130 has the shape of the cylinder or the square pillar. The case 130 has an end portion in contact with the conductive pattern 141 of the PCB substrate 140 and has a closed bottom surface to prevent an inflow of the external sound as well. The case 130 is attached to the PCB substrate 140 by aligning the metal case 130 on the conductive pattern 141 formed on the PCB substrate 140 and then spot-welding at least two points by a laser welding or a spot welding and then sealing a contacting portion of the case 130 and the PCB substrate 140 with an adhesive 164 such as an epoxy. A reference numeral 162 denotes a welding point.

In accordance with a method for manufacturing the silicon condenser microphone 100 of the first embodiment, after the chamber case 150 is mounted on the PCB substrate 140 such that the sound hole 140*a* of the PCB substrate 140 is positioned inside the additional back chamber 152 and the ASIC chip 120 is mounted on the PCB substrate 140, the MEMS chip 110 is attached to the chamber case 150 such that the through-hole 150*a* of the chamber case 150 is positioned inside the back chamber 15 of the MEMS chip 110.

Thereafter, the case 130 having the shape of the cylinder or the square pillar is fixed to the conductive pattern 141 of the PCB substrate 140 by the laser welding. The case 130 is bonded to the PCB substrate 140 by the adhesive 164. The adhesive 164 may be a conductive epoxy, a non-conductive epoxy, a silver paste, a silicon, a urethane, an acryl and/or a cream solder.

Referring to FIG. 3, the MEMS chip 110 having the additional back chamber 152 formed by the chamber case 150 and the ASIC chip 120 are mounted on the PCB substrate 140, and the square or circular conductive pattern 141 is disposed at a portion that is in contact with the case 130 having the shape of the cylinder or the square pillar. Since a size of the PCB substrate 140 is larger than that of the case 130 having the shape of the cylinder or the square pillar, a connection pad or the connection terminal for connecting to an external device may be freely disposed on the large PCB substrate, and the conductive pattern 141 may be manufactured by disposing a copper film via a conventional PCB manufacturing process and then plating a nickel or a gold. A ceramic substrate, a flexible PCB (FPCB) substrate or a metal PCB may be used instead of the PCB substrate 140.

The case 130 having the shape of the cylinder or the square pillar has a contacting surface with the PCB substrate 140 open such that chip components may be housed inside, wherein an upper surface thereof is closed the external sound does not flows in. The case 130 may be manufactured using a brass, a copper, a stainless steel, an aluminum or a nickel alloy and may be plated with gold or silver.

After aligning the case 130 to the conductive pattern 141 of the PCB substrate 140, a welding point 162 which is a portion of the contacting portion is welded with the laser using a laser welder (not shown) to fix the case 130 to the PCB substrate 140. Thereafter, an assembly of the microphone is complete by applying the adhesive 164 to the entire contacting portion. The welding refers to spot-welding one or more points (preferably two or four points) in order to fix the case 130 to the PCB substrate 140 rather than welding an entire contacting surface of the case 130 and the PCB substrate 140. A bonding point formed between the case 130 and the PCB substrate 140 through such welding is referred to as the welding point 162. The case 130 is fixed to the PCB substrate 140 by the welding point 162 such that the case 130 is not moved during a bonding using the adhesive 164 or a curing process for bonding at a proper position. In addition, the conductive pattern 141 is connected to the ground connection terminal 144 through the through-hole 146, and when the case 130 is bonded, external noise is blocked to remove the noise.

At least two and up to eight connection terminals 142 and 144 for connecting to the external device may be formed at a bottom surface of the PCB substrate 140, and each of the connection terminals 142 and 144 is electrically connected to a chip component side through the through-hole. Particularly, in accordance with the embodiment of the present invention, when the connection terminals 142 and 144 extend about the PCB substrate 140, the rework may be facilitated by using an electric solder through an exposed surface.

In accordance with the embodiments of the present invention, while the laser welding is exemplified as a method for fixing the case 130 to the PCB substrate 140, a soldering or a punching may be used for fixing the case 130 to the PCB substrate 140, and the conductive epoxy, the non-conductive epoxy, the silver paste, the silicon, the urethane, the acryl or the cream solder may be used as the adhesive 164.

Figure 4:
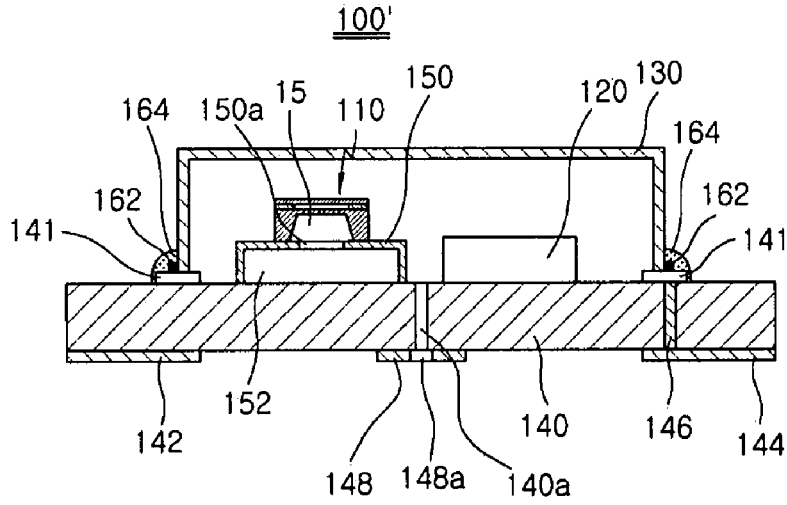
FIG. 4 is a lateral cross-sectional view illustrating a silicon condenser microphone having an additional back chamber and a sound hole in a PCB in accordance with a second embodiment of the present invention.

FIG. 4 is a lateral cross-sectional view illustrating a silicon condenser microphone having an additional back chamber and a sound hole in a PCB in accordance with a second embodiment of the present invention. A difference between the silicon condenser microphone 100 of the first embodiment and the silicon condenser microphone 100' of the second embodiment is a position of the sound hole 140*a* formed in the PCB substrate 140, wherein the sound hole 140*a* is formed at a position of the additional back chamber 152 formed by the chamber case 150 in case of the first embodiment and the sound hole 140*a* is formed between the chamber case 150 and the ASIC chip 120 away from the chamber case 150 in case of the second embodiment.

Therefore, while the silicon condenser microphone 100 of the first embodiment has a back type structure wherein the external sound passes through the sound hole 140*a* of the PCB substrate 140 to reach the additional back chamber 152, the silicon condenser microphone 100' of the second embodiment has a structure wherein the external sound passes through the sound hole 140*a* of the PCB substrate 140 and then passes through a space in the case 130 to reach the MEMS chip 110. In accordance with the first embodiment, it is preferable that positions of the backplate 13 and the vibrating plate 11 are exchanged in a structure of the MEMS chip shown in FIG. 1.

In accordance with the silicon condenser microphone 100' of the second embodiment, since a constitution thereof is identical to that of the silicon condenser microphone 100 of the first embodiment except the position of the sound hole 140*a*, an additional detailed description is omitted.

Figure 5:
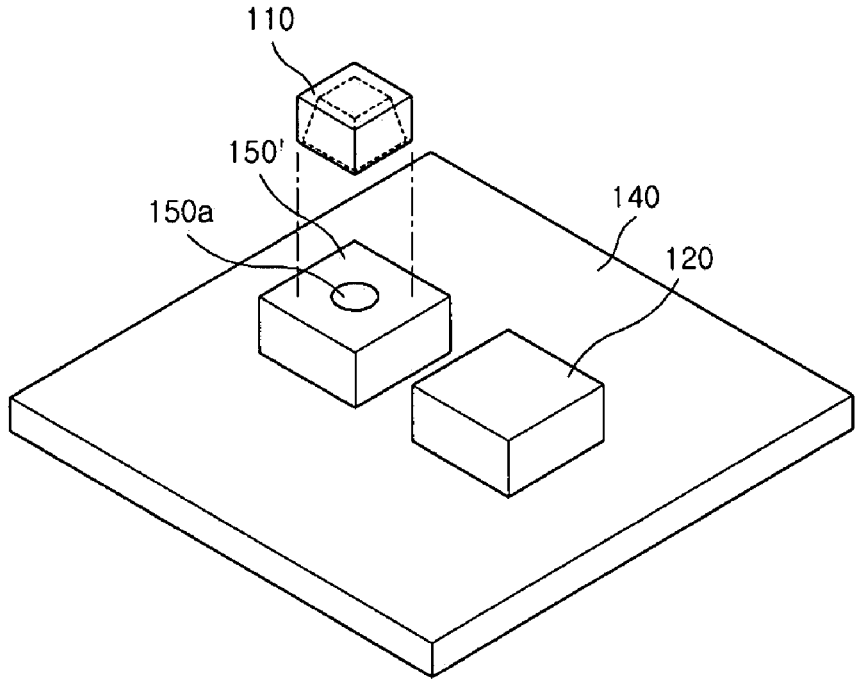
FIG. 5 is a diagram exemplifying an additional back chamber in a form of a square pillar in accordance with the present invention.
Figure 6:
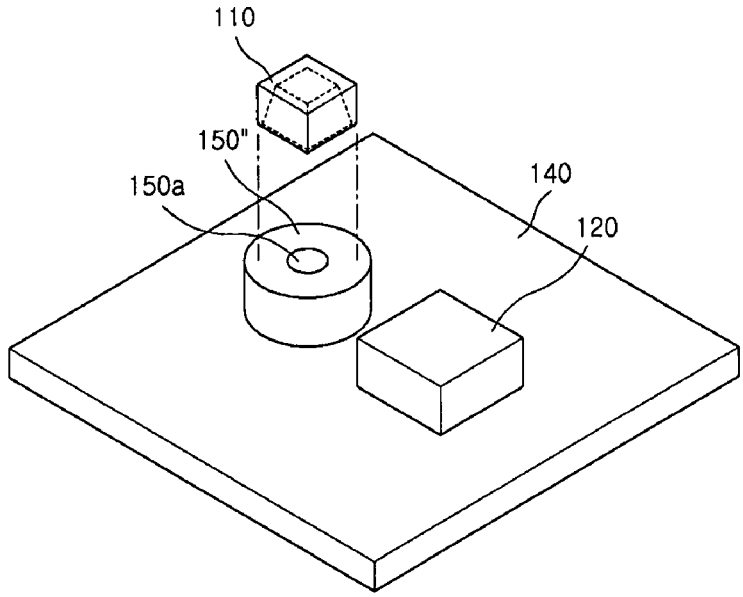
FIG. 6 is a diagram exemplifying an additional back chamber in a form of a cylinder in accordance with the present invention.

FIG. 5 is a diagram exemplifying an additional back chamber in the form of the square pillar in accordance with the present invention, and FIG. 6 is a diagram exemplifying an additional back chamber in the form of the cylinder in accordance with the present invention.

As shown in FIGS. 5 and 6, the chamber case 150 for forming the additional back chamber 152 may have the shape of the square pillar 150' and the cylinder 150", and the through-hole 150*a* is disposed on an upper portion of the square pillar 150' or the cylinder 150" to form a path with the back chamber 15 of the MEMS chip 110.

The silicon condenser microphone 100 having various shapes may be manufactured by attaching the case 130 having various shapes on the PCB substrate 140. The ASIC chip 120 and the MEMS chip 110 are mounted on the PCB substrate 140. The MEMS chip 110 includes the additional back chamber 152 by the chamber case 150. For instance, the case may have the shape of the cylinder, the square pillar, a cylinder having a wing at an end thereof, or a square pillar having a wing at an end thereof.

Figure 7:
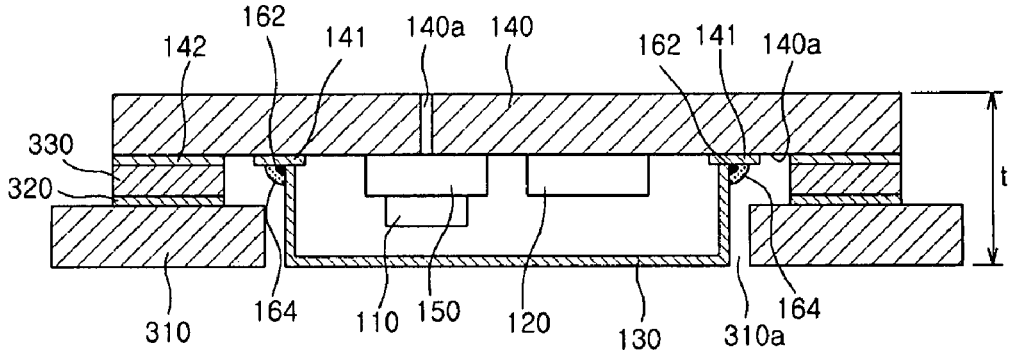
FIG. 7 is a lateral cross-sectional view illustrating an example wherein a microphone having a connection terminal formed on a component surface is mounted on a main PCB in accordance with the first embodiment of the present invention.

FIG. 7 is a lateral cross-sectional view illustrating an example wherein a microphone having a connection terminal formed on a component surface is mounted on a main PCB in accordance with the first embodiment of the present invention.

As shown in FIG. 7, in accordance with a silicon condenser microphone according to an alternate first embodiment, after the case 130 having the shape of the cylinder or the square pillar is fixed to the PCB substrate 140 larger than the case by welding, the case 130 is bonded by the adhesive 164. The connection terminals 142 and 144 for connecting to a connection pad 320 of the main PCB 310 of a product on which the microphone is mounted are disposed in the component side of the PCB substrate 140. At least two and up to eight connection terminals may be formed. The reference numeral 162 denotes the welding point. When the connection terminals extend to a sidewall of the substrate or extend to an opposite surface of the component side in addition to the sidewall, heat transfer of the electric solder is improved to facilitate the rework.

The main PCB 310 of the product on which the silicon condenser microphone is mounted comprises a circular or a square inserting hole 310*a* in order to mount the case 130 of the silicon condenser microphone. The connection pad 320 corresponding to the connection terminals 142 and 144 is disposed on the PCB substrate 140 of the microphone.

As shown in FIG. 7, in accordance with the silicon condenser microphone mounted on the main PCB 310, the connection pad 320 of the main PCB 310 is coupled to the connection terminals 142 and 144 by soldering 330. The case 130 extruding at a center of the component side of the substrate 140 is inserted the inserting hole 310*a* of the main PCB 310.

Therefore, in accordance with a mounting method of the present invention, since the case 130 extruding over the PCB substrate of the microphone is inserted in the inserting hole 310*a* of the main PCB 310, an overall height after the mounting is smaller than the conventional microphone wherein the connection terminals are formed on an opposite side of the component side to be mounted the main PCB, resulting in an efficient use of a space needed for mounting the product.

Figure 8:
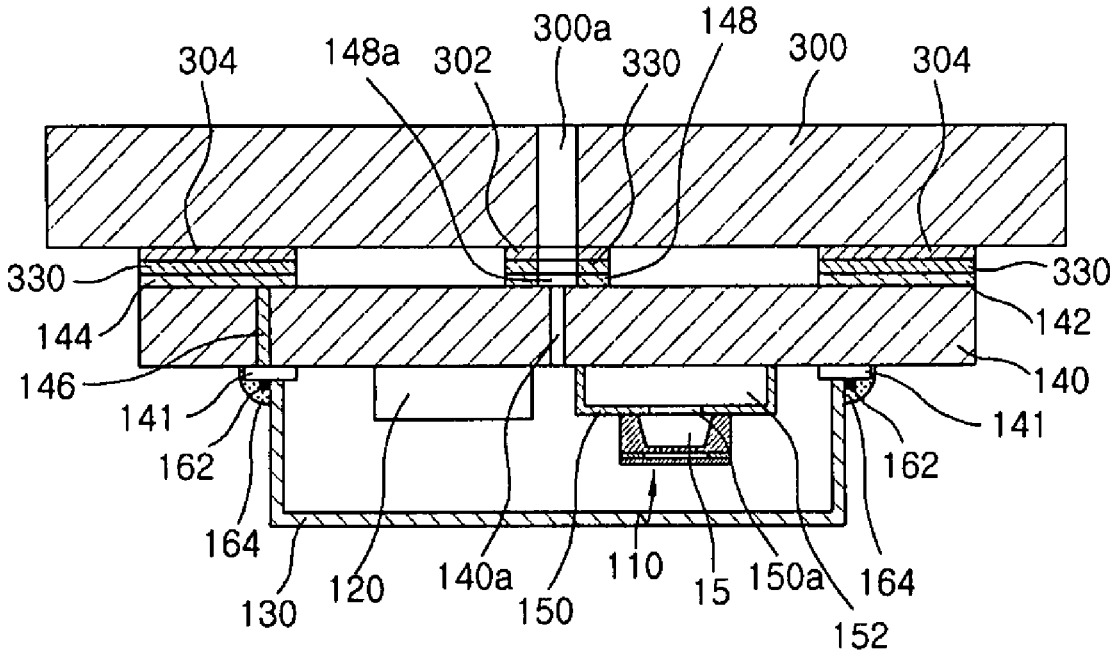
FIG. 8 is a lateral cross-sectional view illustrating an example wherein a microphone is mounted on a main PCB in accordance with the second embodiment of the present invention.

FIG. 8 is a lateral cross-sectional view illustrating an example wherein a microphone is mounted on a main PCB in accordance with the second embodiment of the present invention.

The silicon condenser microphone in accordance with the second embodiment of the present invention has a constitution identical to that of FIG. 4, and a main PCB 300 for mounting the silicon condenser microphone of the second embodiment comprises a sound hole 300*a* for passing through a sound form an external source, a sealing pad 302 disposed around the sound hole 300*a*, and a connection pad 304 corresponding to the connection terminals 142 and 144 of the microphone as shown in FIG. 8.

Therefore, after aligning the sound hole 140*a* formed on the PCB substrate 140 of the silicon condenser microphone of the second embodiment to the sound hole 300*a* of the main PCB 300 and connecting terminals 142 and 144 to the connection pad 304, the silicon condenser microphone is attached to the main PCB 300 via a soldering 330.

The present invention includes a chamber case for forming an additional back chamber under a MEMS chip in order to increase a back chamber space of the MEMS chip, thereby improving sensitivity and noise problems such as a THD (Total Harmonic Distortion).

The invention claimed is:

1. A silicon condenser microphone comprising:

a case for blocking an inflow of an external sound;

a substrate;

a chamber case located on top of the substrate;

a Micro Electro Mechanical System (MEMS) chip having an additional back chamber formed by the chamber case;

an application specific integrated circuit (ASIC) chip for operating the MEMS chip;

a conductive pattern for a bonding to the case; and a sound hole for passing the external sound therethrough;

a fixing means for fixing the case to the substrate; and an adhesive for bonding the case and the substrate, wherein the adhesive is applied to an entirety of a bonding surface of the case and the substrate fixed by the fixing means.

2. The microphone in accordance with claim 1, wherein the sound hole is disposed on a portion of the substrate corresponding to a position of the additional back chamber.

3. The microphone in accordance with one claim 1, further comprising a sealing pad for preventing a distortion of an acoustic wave, the sealing pad being disposed around the sound hole of the substrate.

4. The microphone in accordance with claim 1, wherein the fixing means comprises a welding point formed by a laser welding or a soldering, and wherein the adhesive comprises one of a conductive epoxy, a non-conductive epoxy, a silver paste, a silicon, a urethane, an acryl and a cream solder.

5. The microphone in accordance with claim 1, wherein the case comprises a cylindrical case or a square pillar case, and wherein an end portion of the case is a straight type or curled outward to form a wing.

6. The microphone in accordance with claim 1, wherein the substrate comprises one of a printed circuit board (PCB), a ceramic substrate, a flexible PCB (FPCB) substrate and a metal PCB.

7. A silicon condenser microphone comprising:

a case for blocking an inflow of an external sound;

a substrate including a chamber case, a Micro Electro Mechanical System (MEMS) chip having an additional back chamber formed by the chamber case, an application specific integrated circuit (ASIC) chip for operating the MEMS chip, a conductive pattern for a bonding to the case, and a sound hole for passing the external sound therethrough, wherein the chamber case comprises a cylindrical chamber case or a square pillar chamber case, and comprises a through-hole connected to a back chamber of the MEMS chip;

a fixing means for fixing the case to the substrate; and an adhesive for bonding the case and the substrate, wherein the adhesive is applied to an entirety of a bonding surface of the case and the substrate fixed by the fixing means.

* * * * *